US008074724B2

(12) United States Patent
Minassian et al.

(10) Patent No.: US 8,074,724 B2
(45) Date of Patent: Dec. 13, 2011

(54) BIT-RUN NOMINAL SEAT PROTECTOR AND METHOD OF OPERATING SAME

(75) Inventors: Marc Minassian, Magnolia, TX (US); Guilherme Eppinghaus, Spring, TX (US); David L. Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 308 days.

(21) Appl. No.: 12/413,054

(22) Filed: Mar. 27, 2009

(65) Prior Publication Data

US 2010/0243271 A1 Sep. 30, 2010

(51) Int. Cl.
*E21B 19/24* (2006.01)
*E21B 33/04* (2006.01)

(52) U.S. Cl. ..... 166/382; 166/75.14; 166/85.3

(58) Field of Classification Search ..... 166/382, 166/75.14, 85.3
See application file for complete search history.

(56) References Cited

U.S. PATENT DOCUMENTS

| | | | | |
|---|---|---|---|---|
| 4,077,472 | A * | 3/1978 | Gano | 166/382 |
| 4,340,259 | A * | 7/1982 | Green | 384/29 |
| 4,361,353 | A * | 11/1982 | Vinson | 294/86.1 |
| 4,362,210 | A * | 12/1982 | Green | 166/85.3 |
| 4,634,152 | A * | 1/1987 | Pettit | 285/39 |
| 4,674,576 | A * | 6/1987 | Goris et al. | 166/382 |
| 4,995,458 | A * | 2/1991 | Garbett | 166/85.3 |
| 5,025,864 | A * | 6/1991 | Nobileau | 166/348 |
| 5,044,438 | A * | 9/1991 | Young | 166/382 |
| 5,109,923 | A * | 5/1992 | Koleilat | 166/117 |
| 5,199,495 | A * | 4/1993 | Brammer et al. | 166/339 |
| 5,762,136 | A * | 6/1998 | Oswald | 166/85.3 |
| 5,819,851 | A | 10/1998 | Dallas | |
| 5,975,211 | A | 11/1999 | Harris | |
| 6,302,211 | B1 * | 10/2001 | Nelson et al. | 166/348 |
| 6,516,861 | B2 | 2/2003 | Allen | |
| 6,719,044 | B2 * | 4/2004 | Ford et al. | 166/85.3 |
| 6,749,018 | B1 * | 6/2004 | Ford et al. | 166/85.3 |
| 6,810,954 | B2 | 11/2004 | Garrett et al. | |
| 6,945,325 | B2 * | 9/2005 | Ford et al. | 166/85.3 |
| 7,040,412 | B2 | 5/2006 | DeBerry | |
| 7,284,616 | B2 * | 10/2007 | Williams et al. | 166/381 |
| 2002/0092656 | A1 * | 7/2002 | Ford et al. | 166/377 |
| 2003/0192704 | A1 * | 10/2003 | Ford et al. | 166/377 |
| 2003/0205385 | A1 | 11/2003 | Duhn et al. | |
| 2005/0103503 | A1 * | 5/2005 | Williams et al. | 166/381 |
| 2006/0185841 | A1 | 8/2006 | Swagerty et al. | |
| 2006/0278438 | A1 * | 12/2006 | Laureano et al. | 175/66 |
| 2010/0243271 | A1 * | 9/2010 | Minassian et al. | 166/378 |
| 2010/0282461 | A1 * | 11/2010 | Yee | 166/255.1 |

FOREIGN PATENT DOCUMENTS

EP 2239411 A2 * 10/2010

* cited by examiner

*Primary Examiner* — Jennifer H Gay
(74) *Attorney, Agent, or Firm* — Bracewell & Giuliani LLP

(57) ABSTRACT

A drilling system employs a set of bushings that protect seats used for casing hangers. The system includes one or more seat protectors that attach to a running tool. The running tool is lowered down the wellbore with the seat protectors attached and deposits a bushing at each surface to be protected. The running tool may retrieve the bushings as the running tool is withdrawn from the wellbore.

22 Claims, 7 Drawing Sheets

BIT-RUN NOMINAL SEAT PROTECTOR AND METHOD OF OPERATING SAME

BACKGROUND OF THE INVENTION

1. Field of the Invention

The present invention relates in general to an improved wear bushing system, and in particular to an improved bit-run wear bushing and tool and method of operation.

2. Brief Description of Related Art

A wear bushing or seat protector is used in drilling applications to protect the inner profiles of the various components in the wellhead. In the prior art, wear bushings typically have been run or lowered down to the wellhead on a separate trip. One type of bit run wear bushing is held to a tool via shear pins. This bit run wear bushing has an internal ledge with a reduced inner diameter for retrieval. However, the bit run wear bushing is not suitable to protect all of the seats inside a wellbore. Thus an improved bit run wear bushing would be desirable.

SUMMARY OF THE INVENTION

Various embodiments of this invention provide a way to protect one or more surfaces inside a wellbore. In an exemplary embodiment, a running tool is attached to a drill string. One or more seat protectors are attached to the running tool. When the drill string is lowered into the wellbore to perform drilling operations, the seat protectors detach from the running tool as the tool passes through the surface to be protected. The seat protectors remain in place during the drilling operation, and are then retrieved when the drill string is withdrawn from the wellbore.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
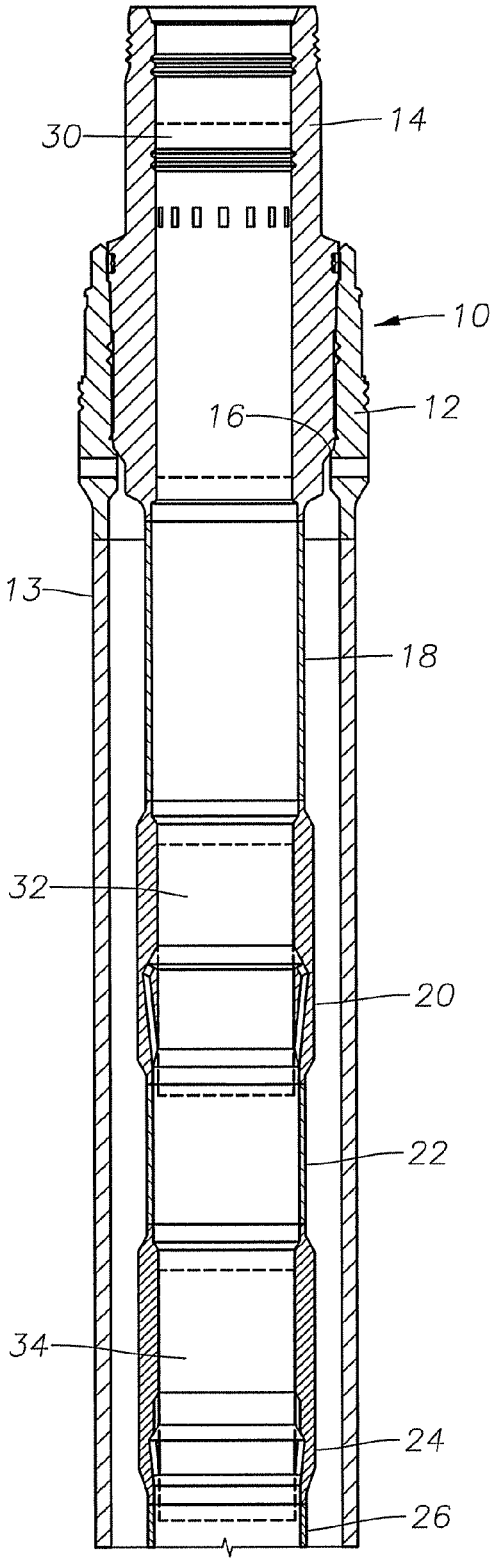
FIG. 1 is a sectional view showing the inside of a wellbore prior to installing a wear bushing.

Referring to FIG. 1, a wellhead 10 is presented, and represented generally by reference numeral 10. The illustrated wellhead 10 has a tubular outer wellhead housing 12 with an inner bore. A string of outer casing or conductor pipe 13 is attached to outer wellhead housing 10. The inner bore concentrically accepts an inner wellhead housing 14 that is supported by an inner wellhead housing support 16 on the outer wellhead housing 12. The inner wellhead housing support 16 is a shoulder on the outer wellhead housing 12 that slopes downward and inward, and mates with the inner wellhead housing 14.

A section of casing 18 is suspended from the inner wellhead housing 14 of the wellhead 10. In an exemplary embodiment, the upper casing 18 is a nominal 22" casing that may extend, for example, several thousand feet down to a first landing sub 20. Below the middle landing sub 20, a middle casing 22 extends downward to a second landing sub 24. A lower casing 26 extends downward from the second landing sub 24.

A nominal seat protector ("NSP") is a type of wear bushing that may be inserted into a wellhead component to protect the bore of the wellhead component from damage as drill bits, drill pipe, etc., are passed back and forth though the bore of the wellhead component. In the illustrated embodiment, an NSP may be deployed within the inner wellhead housing 14 and landing subs 20, 24 to protect bore surfaces of the inner wellhead housing and/or landing subs. A first NSP 30 is illustrated with dashed lines within the inner wellhead housing 14. In addition, a second NSP 32 is provided to protect bore surfaces of the first landing sub 20. Finally, a third NSP 34 is presented in the illustrated embodiment to protect bore surfaces of the second landing sub 24.

The minimum inner diameter of the landing shoulder in wellhead housing 14 is greater than the minimum inner diameter of middle landing sub 20. In addition, the minimum inner diameter of middle landing sub 20 is greater than the minimum inner diameter of lower landing sub 24. Similarly, the outer diameter of first NSP 30 is greater than the outer diameter of second NSP 32, which is greater than the outer diameter of third NSP 34.

In the illustrated embodiment, the NSPs are bit-run NSPs that are deployed by a running tool deployed as part of a drill string having a drill bit at the bottom (not shown in FIG. 1). The running tool is used to install all three NSPs 30, 32, 34 on a single trip of the drill string into the well. In the Illustrated embodiment, the NSPs 30, 32, 34 are attached to the running tool and sequentially released as the drill string is lowered down the wellbore.

As the drill string is lowered down through the inner wellhead housing 14, the second NSP 32 and the third NSP 34 pass through the wellhead 12. However, when the first NSP 30 reaches the inner wellhead housing 14, the first NSP 30 engages the inner wellhead housing 14 and detaches from the second NSP 32 and the running tool, thereby remaining in the inner wellhead housing 14. The portions of the drill string above the inner wellhead housing 14 continue to descend through the center of the first NSP 30.

When the running tool reaches the first landing sub 20, the third NSP 34 passes through the first landing sub 20. However, the second NSP 32 engages the first landing sub 20 and detaches from the third NSP 34 and the running tool, remaining in place inside the first landing sub 20. As above, the drill string continues to descend through the second NSP 32. Finally, when the running tool reaches the second landing sub 24, the third NSP 34 engages the second landing sub 24 and detaches from the running tool, remaining in place to protect the second landing sub as the drill string continues to descend through the third NSP 34. The design and operation of the running tool and NSP bushings will be discussed in greater detail in FIGS. 4-11.

As noted above, in the illustrated embodiment, three NSPs are deployed. In this embodiment, the first NSP 30 is a 22" NSP, the second NSP 32 is a 16" NSP, and the third NSP 34 is an 18" NSP. The dimensions 22", 16", and 18" correspond to the nominal size in inches of the pipe which will eventually hang on the inner wellhead housing 14 and the landing subs, respectively. However, NSPs having other diameters may be used. Any number of NSPs may be deployed on a single trip, including, for example, two, three, four, or more. The NSPs may be sized to fit on any size seat within the wellhead and may be used with any size pipe.

Figure 2:
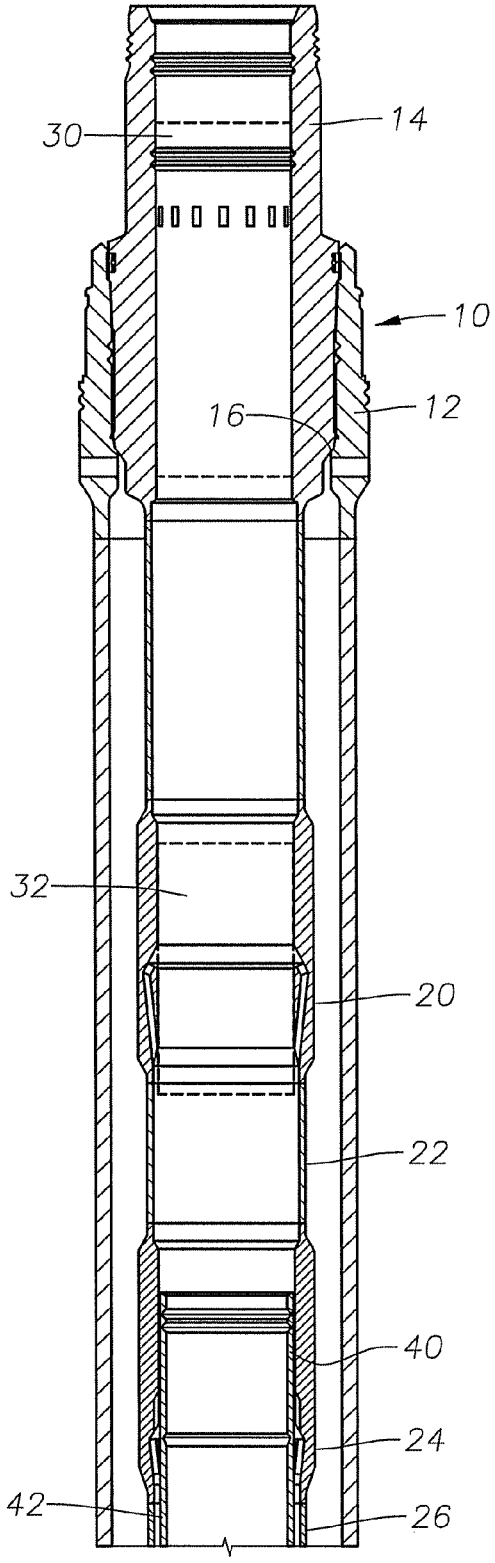
FIG. 2 is a sectional view showing the wellbore of FIG. 1 with a lower casing string installed, prior to installing a wear bushing.

Referring generally to FIG. 2, in the exemplary embodiment, after drilling through the assembly of FIG. 1, all three NSPs 30, 32, 34 are retrieved. Then a string of casing 42 is installed with a casing hanger 40 landing on lower landing sub 24. After cementing casing 42, the operator re-runs the drill string and running tool and re-deploys an upper NSP 30 and a second NSP 32 in the wellhead 10. In an exemplary embodiment, the lower landing sub 24 is a nominal 18" landing sub, which supports a nominal 18" lower casing hanger 40. A medium diameter casing 42 is suspended from the lower casing hanger 40. The medium diameter casing 42 may extend several thousand feet below the lower landing sub 24. The first NSP 30 may be used to protect the inner wellhead housing 14 and the second NSP 32 may be used to protect the first landing sub 20 after the casing hanger 40 is installed in the second landing sub 24.

Figure 3:
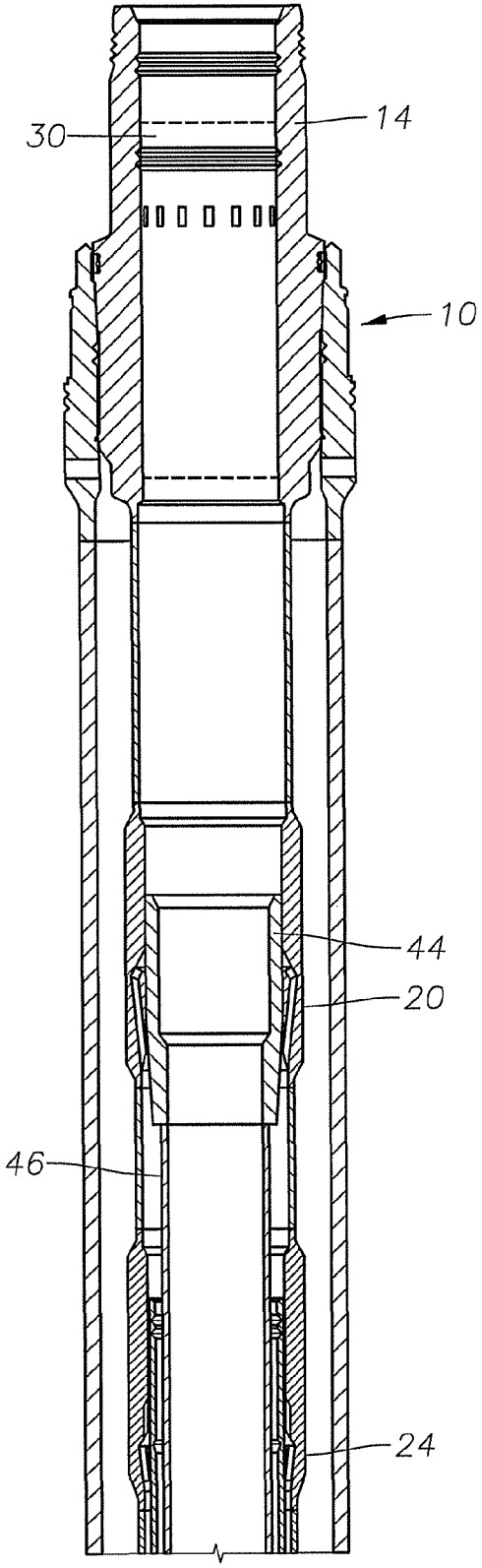
FIG. 3 is a sectional view showing the wellbore of FIG. 1 with a lower and middle casing string installed, prior to installing a wear bushing.

Referring to FIG. 3, in an exemplary embodiment, the operator has drilled deeper through casing 42 and retrieved the running tool and NSPs 32 and 34. The operator then installs a string of casing 46 attached to a middle casing hanger 44. After cementing, the operator runs the drill string down and re-deploys a first NSP 30 in the inner wellhead housing 14. In FIG. 3, the middle landing sub 20 supports a middle casing hanger 44. In an exemplary embodiment, the middle landing sub 20 is a nominal 16" landing sub, which supports a nominal 16" middle casing hanger 44. A small diameter casing 46 is suspended from the from the middle casing hanger 44. In an exemplary embodiment, the small diameter casing 46 is a nominal 16" casing. The small diameter casing 46 may extend several thousand feet below the middle landing sub 20, and extends through the lower landing sub 24. The first NSP 30 may be used to protect the inner wellhead housing 14 after the middle casing hanger 44 is installed in the middle landing sub 20 and the well is being drilled deeper. Subsequently, the operator retrieves the drill string and the first NSP 30, then runs a final string of casing which is supported on wellhead housing 14.

Figure 4:
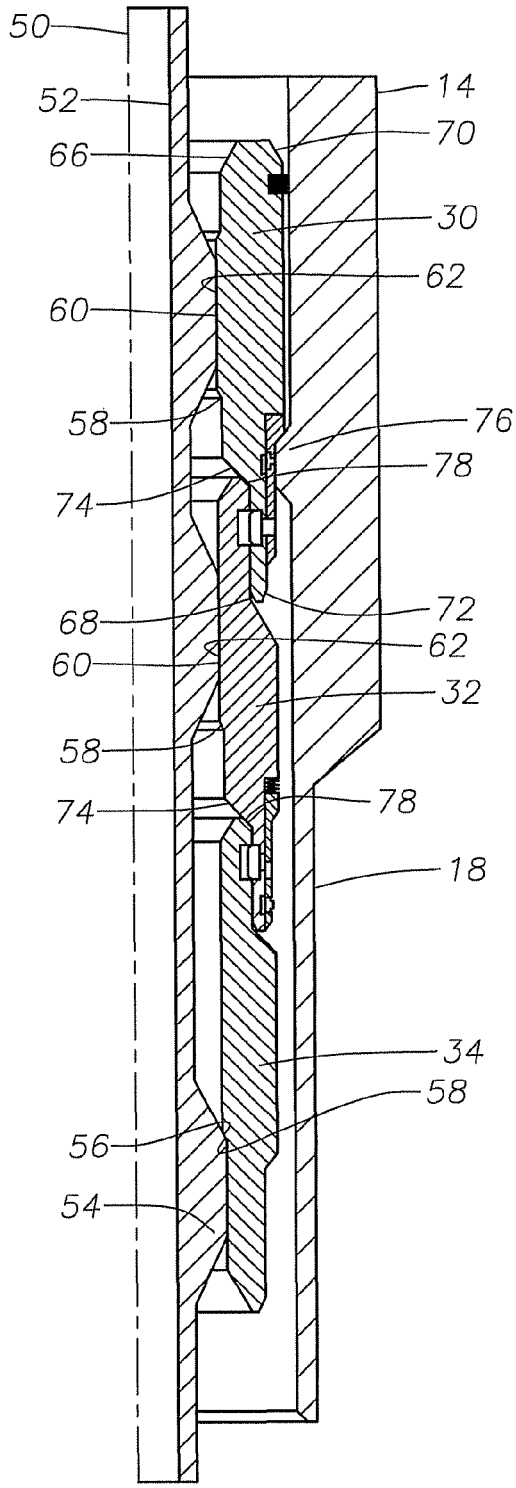
FIG. 4 is a quarter sectional view of a set of seat protectors in the wellhead housing of FIG. 1.

Referring to FIG. 4, in the illustrated embodiment, the bit run NSPs 30, 32, 34 are bushings that have a cylindrical shape rotated about an axis 50 with a bore through their centers. The outer diameter ("OD") of the first NSP 30 is smaller than the inner diameter ("ID") of the wellhead housing 14, with the exception of the wellhead housing 14 shoulder 76 which will be described in FIG. 5. As noted above, the OD of the second NSP 32 is smaller than the wellhead housing 14 ID and the casing 18, and thus it is also less than the OD of the top NSP 30. The OD of the third NSP 34 is smaller than the ID of the wellhead housing 14 and the intermediate landing sub 20, and is also less than the OD of the intermediate NSP 32.

The bit run NSP running tool 52 supports the NSPs 30, 32, 34 during installation and removal. The running tool 52 has a support rib 54 that engages the bottom-most NSP 34. A shoulder 56 on the engagement rib 54 contacts a shoulder 58 on the third NSP 34. Each of the NSPs 30, 32, 34 has a shoulder to engage the engagement rib 54. Thus any of the NSPs may be placed in the bottom-most position on the running tool 52.

The running tool 52 also has a centralizer 60. The centralizer could be ribs 60, which are a set of raised surfaces around the outside of the running tool 52. The outermost portion of the centralizer rib 60 contacts the ID of the intermediate 32 and upper 30 NSP rings. The centralizer ribs 60 keep the intermediate 32 and upper 30 NSP rings centered on the running tool 52 during insertion and removal.

The ID of the first NSP 30 and second NSP 32 each has a running tool reference surface 62. This surface 62 may have the smallest diameter of any feature on the NSP 30, 32. The centralizer rib 60 contacts the reference surface 62 to align the NSPs 30, 32 on the running tool 52. In some embodiments, the NSP may have a surface with a smaller ID than the reference surface such as, for example, a spline that extends inward beyond the diameter of the reference surface.

The top and bottom of the NSP may have chamfers forming a shoulder on the ID 66, 68, the OD 70, 72, or both. The chamfers may help align the NSP into mating surfaces. The inner chamfer surface 68 at the bottom of the first NSP 30 may help align the NSP with a lower NSP 32 or with the running tool 52. Similarly, the lower support chamfer 74 on the NSP 30 may help align the running tool 52 in the first NSP 30. The support chamfer 74 could also support the first NSP 30 on a lower NSP, such as the second NSP 32 and third NSP 34.

The outer chamfer surface 72 at the bottom of the first NSP 30 may help align the first NSP 30 with shoulder 76, which can also function as a support rib, on the high pressure housing 14 during insertion and also facilitate smooth movement through the wellbore. The outer chamfer surface 70 of the first NSP 30 may help guide the first NSP 30 through the wellbore during removal.

The upper support chamfer 78 on the second 32 and third 34 NSPs may be used to support another NSP. The upper support chamfer 78 may contact the lower support chamfer 74 on an adjacent NSP. The upper support chamfer 78 may also guide and align the third 34 or second NSP 32 when it is not mated with an NSP above it as it moves through the wellbore.

In this view, the running tool 52 supports the third NSP 34 on the bottom of the running tool. The third NSP 34 supports the second NSP 32, which in turn supports the first NSP 30. The three NSP rings may be attached to each other and loaded onto the running tool 52 on the drilling rig platform (not shown) and then lowered together on a single trip down into the wellbore. In an alternative embodiment, each of the NSP rings 30, 32, 34 may be independently attached to the running tool rather than nesting with each other.

Figure 5:
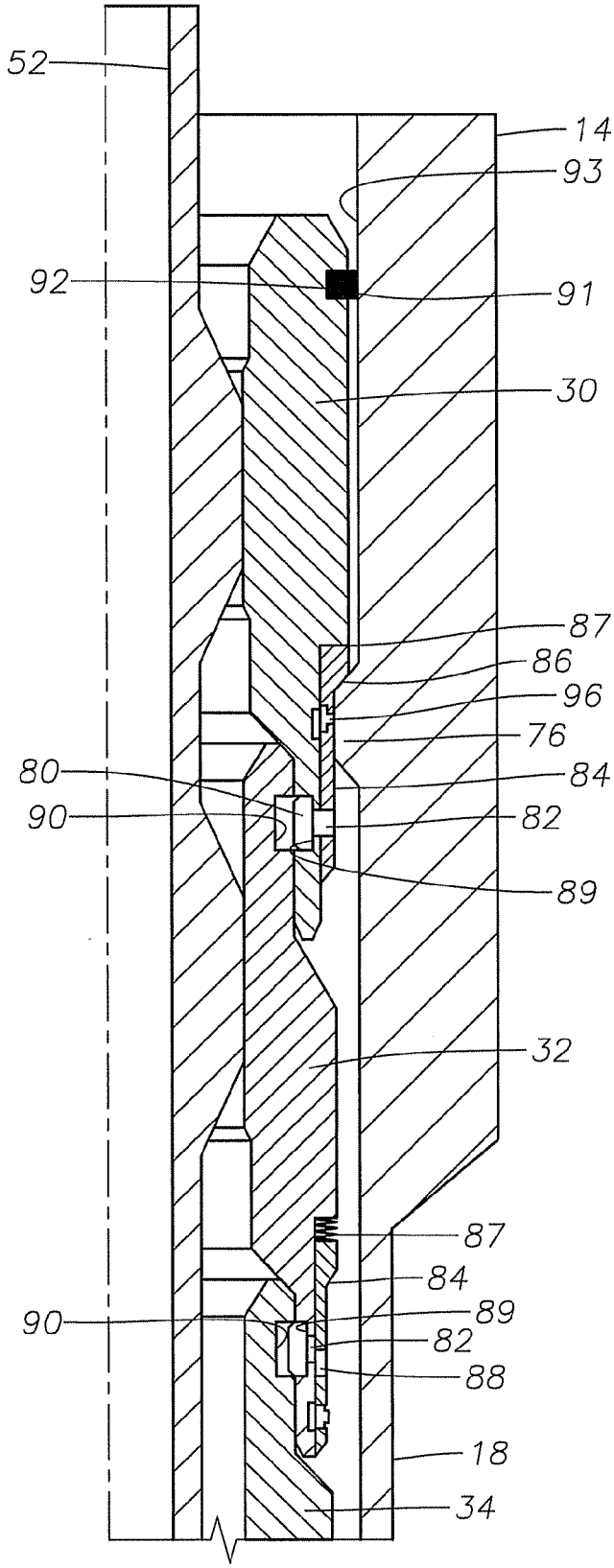
FIG. 5 is a quarter sectional detail view showing a set of seat protectors in the wellhead housing of FIG. 1.

Referring to FIG. 5, in an exemplary embodiment, first NSP 30 has a retainer to prevent one NSP from disengaging the adjacent NSP, such as, for example, to prevent first NSP 30 from prematurely disengaging second NSP 32. The retainer could be, for example, a latch mechanism such as a lock ring 80. The lock ring 80 fits in a groove 89 on the first NSP 30 and in a corresponding groove 90 on second NSP 32. The lock ring 80 keeps the grooves aligned. The lock ring 80 could be, for example, a split or snap ring. One or more release pins 82 located behind the lock ring 80 prevent the lock ring 80 from disengaging the second NSP 32. In its natural state, the lock ring 80 expands to release the adjacent NSP 32. The release pins 82 prevent the lock ring from expanding.

The NSP has a sliding sleeve 84 that contacts a shoulder 86 on the well head housing 14 or landing sub. The sliding sleeve 84 blocks the release pins 82 from moving. Alternatively, the well head housing 14 could be a landing sub. When the sliding sleeve 84 contacts the shoulder 86, the sliding sleeve 84 is held stationary while the NSP 30 continues to move down in the wellbore. The sliding sleeve 84 has a return spring 87 that normally holds the sliding sleeve 84 in the down position. The return spring 87 is illustrated in the expanded position and sliding sleeve 84 in the down position on the second NSP 32 in FIG. 5. This is the position of the sliding sleeves 84 on the NSPs 30, 32 when the running tool 52 is moving the NSPs 30, 32 through the wellbore. The first NSP 30 in FIG. 5 depicts the return spring 87 in its collapsed state and the sliding sleeve 84 in the up position.

The sliding sleeve 84 has a hole or notch 88. When the notch 88 aligns with the release pin 82, the release pin goes into the notch, allowing the lock ring 80 to disengage from the groove 90 in the adjacent NSP 34. When the sliding sleeve 84 is in the down position, the notch 88 is not aligned with the release pin 82 and thus the release pin does not allow the lock ring 80 to expand to its natural state. The first 30 and second 32 NSPs have lock ring mechanisms. The second NSP 32 and third NSP 34 have grooves 90 to receive a lock ring.

The OD of the first NSP 30 is greater than the ID of the shoulder 86 on the wellhead housing shoulder 76. Thus the shoulder 86 supports the NSP 30. The OD of the second and third NSPs 32, 34 is less than the ID of shoulder 86, thus the second and third NSPs 32, 34 may pass through the shoulder 86.

Referring to FIG. 5, in an exemplary embodiment, a lockdown device may be used to provide resistance to removal of an NSP installed on a landing sub. The lockdown device could be, for example, an o-ring 91, a collet, or an elastomer ring on the exterior of the NSP. The NSP may have a groove 92 or some other shape to hold the lockdown device in place. The interior of the wellhead housing 14 and landing subs 20, 24 may have a mating surface 93 that corresponds to the location of the lockdown device of an installed NSP 30, 32, 34. The mating surface 93 could be a groove, a smooth surface, or could be any other shape. The mating surface 93 could be on the wellhead housing or landing sub, but could also be on any other surface within the wellbore upon which the NSP could be installed.

Figure 6B:
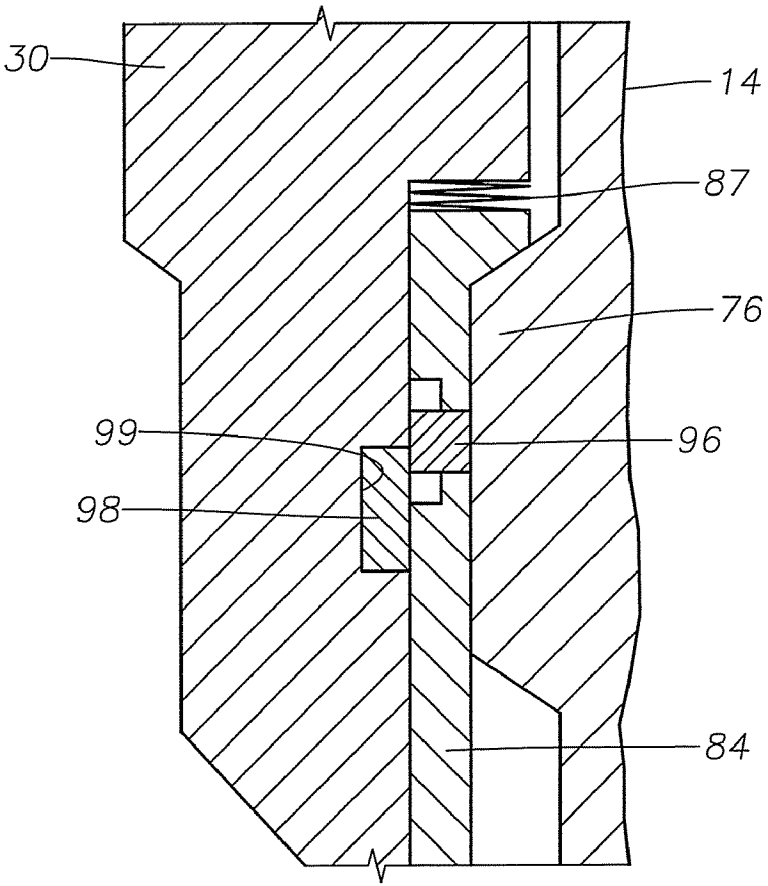
FIGS. 6A and 6B are quarter sectional views showing the smart latch device of the seat protectors of FIG. 4.
Figure 6A:
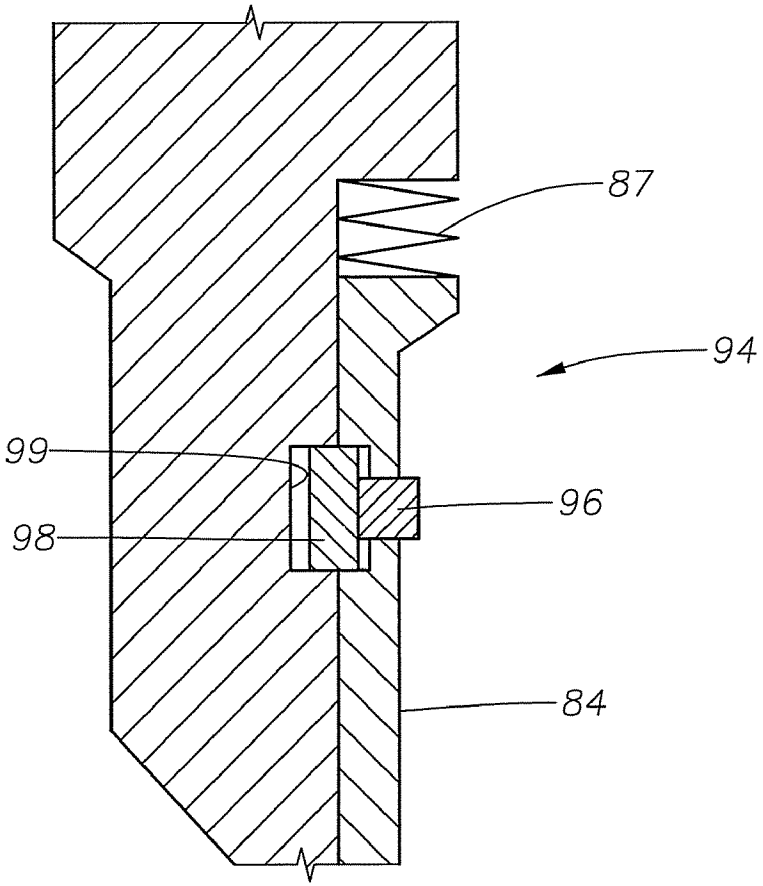

Referring to FIG. 6A and 6B, a smart latch device 94 may be used to prevent the sliding sleeve 84 from moving to the up position prematurely. A smart latch 94 could be any device that locks the sliding sleeve 84 in place during movement, and unlocks only when the NSP 30, 32 is at a proper location for release, such as at the well head housing 14. In an exemplary embodiment, the smart latch 94 is a series of pins 96 around the circumference of the sliding sleeve 84 carried in a groove 99 (FIG. 5). The shoulder 76 on the wellhead housing 14 depresses the pins 96 by, for example, pressing against the pins 96, which in turn compress an expandable ring 98 that is in contact with the pins. When the pins are pressed in, the expandable ring 98 moves deeper into the groove 99, and thus clear the sliding sleeve 84, allowing the NSP 30 to move downward relative to the sliding sleeve 84. The expandable ring 98 could be, for example, a split ring. In an exemplary embodiment, the shoulder 76 (FIG. 5) on the well head housing 14 is the only device inside the wellbore that is sized to release the smart latch 94. The smart latch 94 may be used on any NSP that has a sliding sleeve and may be located anywhere on the sliding sleeve.

The well head housing 14 (FIG. 6B) pushes the first NSP 30 smart latch 98 in to unlock the sliding sleeve 84. Referring to FIG. 5, shoulder 76 of wellhead housing 14 pushes against the sliding sleeve 84, which allows the release pins 82 to move out, which disengages the locking ring 80. The first NSP 30 sits on the wellhead housing 14 and remains in place while the running tool 52 and the second and third NSPs 32, 34 continue down the wellbore. Similarly, the second NSP 32 may have a smart latch mechanism on its sliding sleeve.

Figure 7:
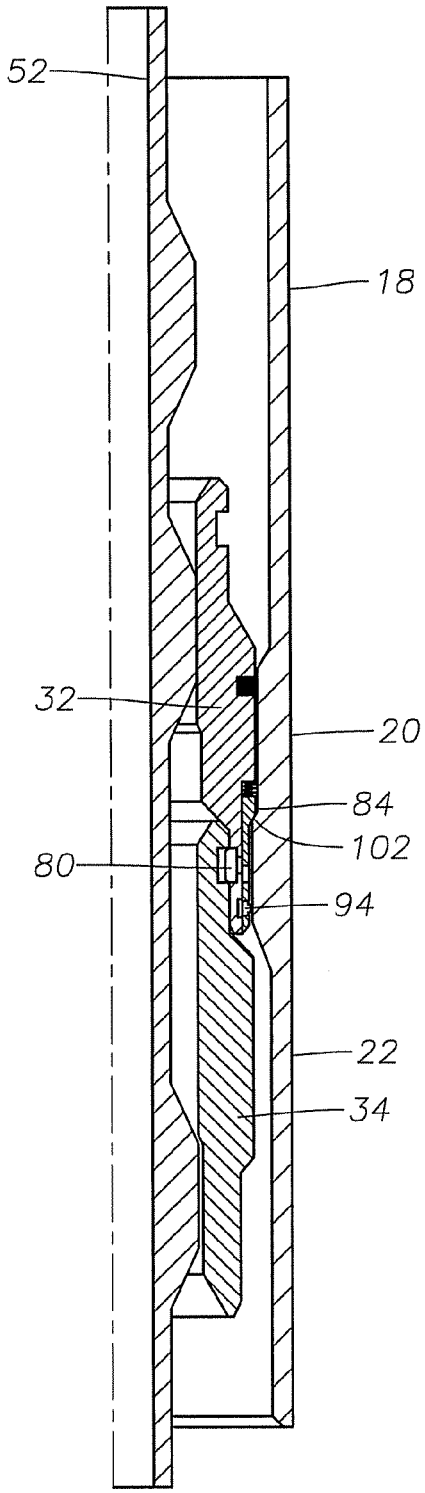
FIG. 7 is a quarter sectional view of two of the seat protectors of FIG. 4 at the intermediate landing sub of FIG. 1.

Referring to FIG. 7, after the first NSP 30 (not shown) is detached from the second NSP 32, the running tool 52 continues to descend the wellbore until it reaches the next landing sub 20. Upon contacting the support rib 102, the sliding sleeve 84, including the locking ring 80 and smart latch 94, all operate in the same manner as the similar components on the top NSP 30. The second NSP 32 detaches from the third NSP 34 and remains in place to protect the first landing sub 20.

The OD of the intermediate NSP 32 is greater than the ID of the support rib 102. Thus the support rib 102 engages the intermediate NSP 32 and holds it in place. The OD of the bottom NSP 34 is less than the OD of support rib 102, and thus the bottom NSP 34 passes through the landing sub 20.

Figure 8:
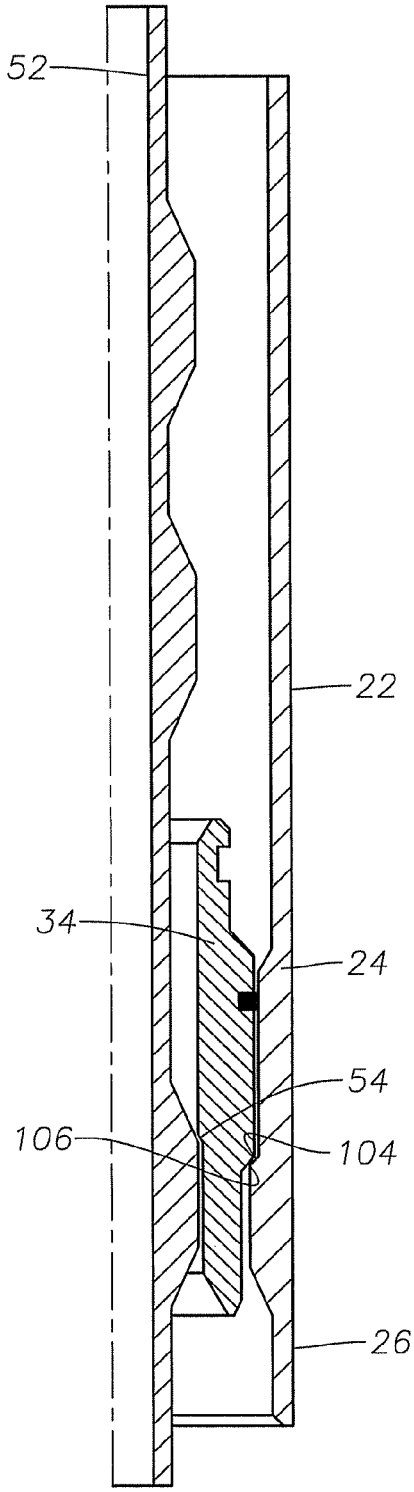
FIG. 8 is a quarter sectional view of one of the seat protectors of FIG. 4 at the lower landing sub of FIG. 1.

Referring to FIG. 8, after the second NSP 32 (not shown) is detached from the bottom NSP 34, the running tool 52 and the bottom NSP 34 continue to descend the wellbore until the third NSP 34 reaches the second landing sub 24. The support rib 104 engages the support surface 106 on the third NSP 34 and engages the third NSP 34 as the running tool 52 continues to descend below the landing sub 24. The third NSP 34 remains in place to protect the second landing sub 24.

The OD of the third NSP 34 is greater than the ID of the shoulder 104, thus the shoulder 104 engages the third NSP 34 as the running tool 52 passes through the second landing sub 24.

Figure 9:
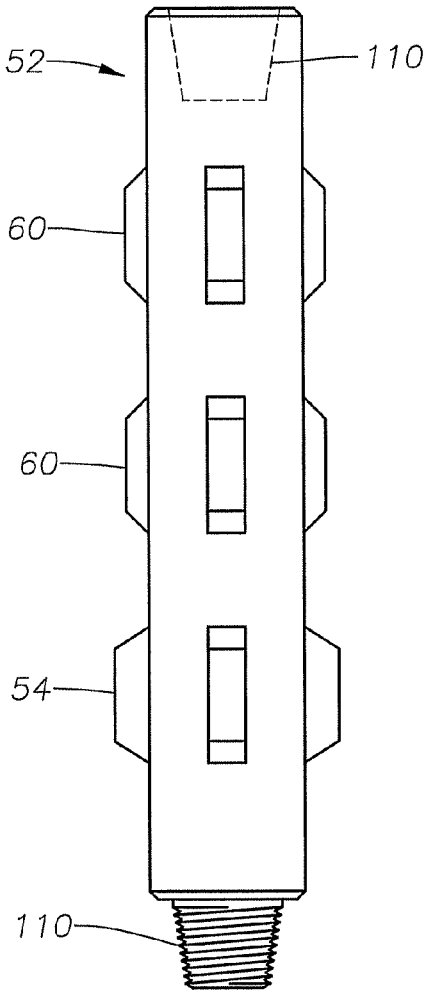
FIG. 9 is a side view of the running tool of FIG. 4.

Referring to FIG. 9, the running tool 52 has threaded ends 110 that allow it to be installed as a section of the drill string (not shown). The running tool 52, with multiple NSP rings 30, 32, 34 (FIG. 4) attached, may be lowered into the wellbore when the drill bit is lowered into the wellbore for the purpose of drilling the well. In an exemplary embodiment, the centralizer ribs 60 that engage the NSP rings (not shown) comprise blades that are spaced circumferentially about the body of running tool 52. The ribs 60 act as a centralizer to center the NSPs on the running tool 52. In an exemplary embodiment, the bottom set of ribs 54 is sized to support the third NSP 34 (FIG. 4). The OD of the support ribs 54 is greater than the minimum ID of the NSPs 30, 32, 34 (FIG. 4) and thus supports the NSPs vertically above it. The ribs 60, 54 may be in any location and shape suitable for engaging one or more NSPs. The engagement surfaces on the NSPs may vary, and thus the configuration of the running tool 52 may vary accordingly.

Figure 10:
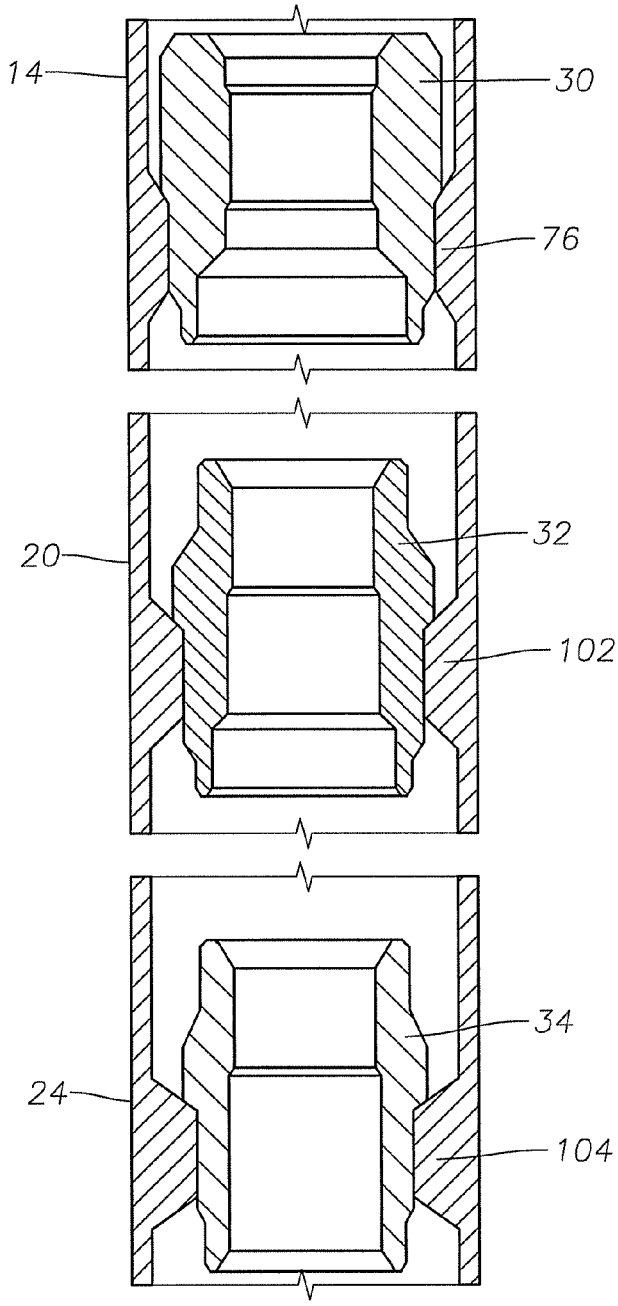
FIG. 10 is a sectional view of the seat protectors of FIG. 4 installed in the wellbore of FIG. 1.

Referring to FIG. 10, the maximum outer diameter ("OD") of the first NSP 30 is larger than the diameters of the second and third NSPs 32, 34. When the running tool 52 is lowered into the wellbore, the first NSP 30 is the first of the NSPs to be engaged, and it is engaged by shoulder 76 on well head housing 14. The well head housing shoulder 76 engages and supports the first NSP 30. The second and third NSPs 32, 34, with their smaller diameters, pass through the top well head housing 14 without engaging it.

The second NSP 32 has the next largest OD, and engages the next landing sub 20 in the same manner the first NSP 30 engaged the first landing shoulder 76. The second NSP 32 has a maximum OD that is larger than the maximum OD of the third NSP 34. The second NSP 32 engages the shoulder 102 on the first landing sub 14 and detaches from the third NSP 34. The running tool 52 and third NSP 34 continue to descend the wellbore.

The third NSP 34 engages the second landing sub 24. The second landing sub 24 lifts the third NSP 34 off of the running tool 52 as the running tool 52 and the drill string continue down the wellbore. The second landing sub 24 has a shoulder 104 that engages and supports the shoulder 106 of the third NSP 34.

Referring to FIG. 4, when the drill string is removed from the wellbore, the NSP rings 30, 32, 34 are removed from the landing subs 24, 20, 14. When the running tool 52 reaches the third NSP 34, the bottom NSP rests on the engagement rib 54 and the engagement rib supports the third NSP 34 as it lifts the NSP ring off of the second landing sub 24. When the third NSP 34 reaches the second NSP 32, the top shoulder 78 on the third NSP 34 contacts the shoulder 74 on the second NSP 32.

As the third NSP 34 lifts the second NSP ring 32 off of the first landing sub 20, the sliding sleeve 84 is lifted off of the landing sub 20. The sliding sleeve return spring 86 is now able to push the sliding sleeve 84 down. This forces the release pins 96 and the lock ring 80 on the second NSP 32 to engage the lock ring receptacle groove 90 on the third NSP 34.

When the second NSP 32 reaches the first NSP 30, the top shoulder 78 on the second NSP 32 contacts the shoulder 74 on the first NSP 30. As the second NSP 32 lifts the first NSP 30 off of shoulder 76 in well head housing 14, the sliding sleeve 84 is lifted off of the shoulder 76. The sliding sleeve return spring 86 is now able to push the sliding sleeve 84 down. This forces the release pins 96 and the lock ring 80 on the first NSP 30 to engage the lock ring receptacle 90 on the second NSP 32.

Figure 11:
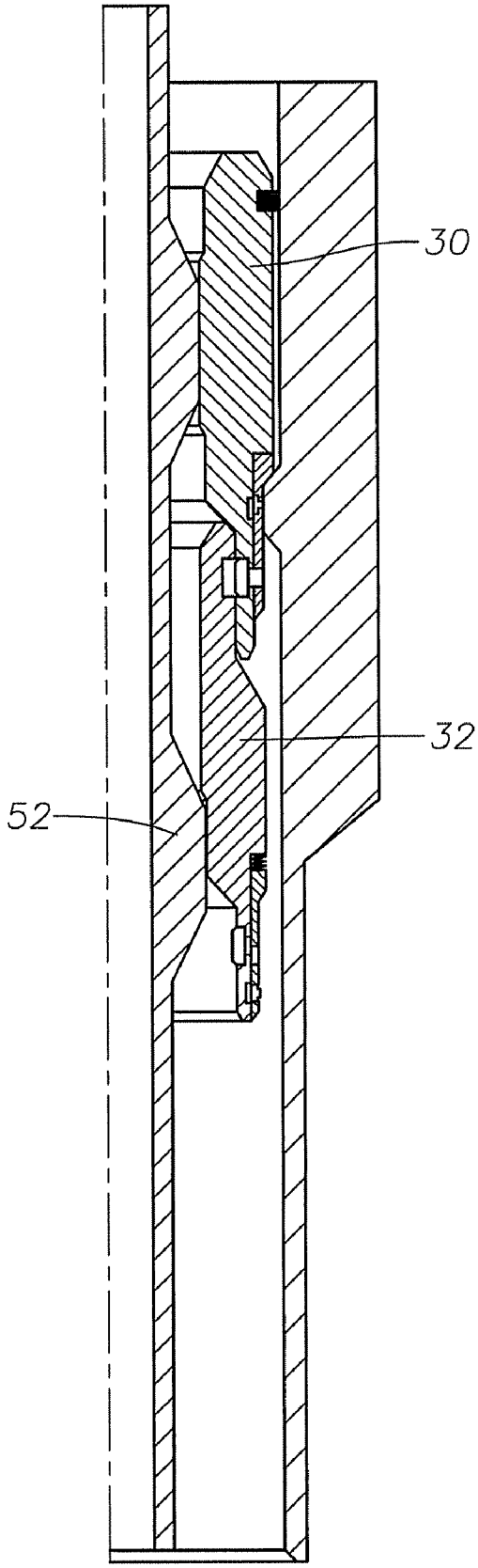
FIG. 11 is a quarter sectional view of an alternative configuration of the seat protectors of FIG. 4.

In an exemplary embodiment, each size NSP ring may nest together with any of the other size NSP rings. Referring to FIG. 4, the third NSP 34, for example, can nest with the second NSP 32. Referring to FIG. 11, if the third NSP ring 34 is not required in an application, the first NSP ring 30 can nest with the second NSP 32 and the second NSP 32 can directly engage the running tool 52 when the third NSP 34 is not present. Furthermore, the third NSP ring 34 is sized to nest directly with the first NSP 30 without the use of second NSP 32. In an exemplary embodiment, any of the NSP rings may engage the running tool 52 directly and thus be used without any of the other NSPs.

In an exemplary embodiment, the weight of the NSP ring is sufficient to hold an installed NSP ring in place on the shoulder 76 of inner wellhead 14 housing and landing subs 20, 24, and thus anti-rotation devices are not necessary. In some embodiments, the bit run NSPs 30, 32, 34 are not required to rotate in place on the landing sub to lock or unlock the NSP in place. Some embodiments may employ anti-rotation devices, such as, for example, a latching mechanism that could require, for example, rotation of the running tool to unlatch the NSP.

In an exemplary embodiment, the inner diameter of one or more of the NSPs is too small for the drill bit to pass through the NSP. In this case, the NSP is retrieved when the running tool passes up through it so that the drill bit can pass through the landing sub. All of the NSPs may be inserted when the drill string goes down into the wellbore, and all of the NSPs are retrieved when the drill string is withdrawn from the wellbore. The running tool to insert and retrieve the NSP rings is part of the drill string, and thus the NSP ring insertion and removal operations are performed during the ordinary insertion and removal of the drill string and do not require additional time or additional trips down the wellbore.

While the invention has been shown or described in only some of its forms, it should be apparent to those skilled in the art that it is not so limited, but is susceptible to various changes without departing from the scope of the invention.

What is claimed is:

1. A well bore surface protection apparatus comprising:

a running tool having first and second ends for securing into a drill string; and a first wear bushing and a second wear bushing, each wear bushing being releaseably disposed on the running tool in a run-in position, the first wear bushing being adapted to disengage the running tool upon landing on a first wellbore component, the second wear bushing remaining in engagement with the running tool and being adapted to pass completely through the first wellbore component as the running tool is lowered below the first wellbore component and disengage the running tool upon landing on a second wellbore component located below the first wellbore component and below the first wear bushing.

2. The assembly of claim 1, further comprising a releasable connection between the first wear bushing and the second wear bushing that releases the second wear bushing from the first wear bushing in response to a downward force applied to the second wear bushing after the first wear bushing lands on the first wellbore component.

3. The assembly of claim 2, wherein an upper portion of the second wear bushing is releasably connected to a lower portion of the first wear bushing while the running tool is in the run-in position.

4. The assembly of claim 1, wherein the running tool further comprises a first centralizer and wherein the first centralizer closely receives an inner diameter of the first wear bushing and a second centralizer that closely receives an inner diameter of the second wear bushing while in the run-in position.

5. The assembly of claim 1, wherein the second wear bushing has a lower end below a lower end of the first wear bushing while disposed on the running tool in the run-in position.

6. The assembly of claim 1, further comprising a releasable connection between the first wear bushing and the second wear bushing that releases the second wear bushing from the first wear bushing in response to a downward force applied to the second wear bushing after the first wear bushing lands on the first wellbore component, the release mechanism comprising a plurality of pins that shift from a first pin position to a second pin position in response to a downward force as applied to the first wear bushing after the first wear bushing lands on the first wellbore component, the first pin position causing the first wear bushing to remain secured to the second wear bushing and the second pin position causing the first wear bushing to release from the second wear bushing.

7. The assembly of claim 1, further comprising a releasable connection between the first wear bushing and the second wear bushing that releases the second wear bushing from the first wear bushing in response to a downward force applied to the second wear bushing after the first wear bushing lands on the first wellbore component and wherein the first wear bushing is located above the second wear bushing while in the run-in position.

8. A wellbore surface protection apparatus comprising:

a first wellbore component having a first landing shoulder and a second wellbore component having a second landing shoulder located below the landing shoulder of the first wellbore component, the first landing shoulder having a greater inner diameter than the second landing shoulder;

a running tool having an upward facing support shoulder;

a first wear bushing supported on the support shoulder of the running tool, the first wear bushing having a maximum outer diameter smaller than a smallest inner diameter of the first wellbore component and greater than the inner diameter of the second landing shoulder;

a second wear bushing supported on the first wear bushing, the second wear bushing having a greater maximum outer diameter than the inner diameter of the first landing shoulder; and a latch mechanism that releasably latches the first and second wear bushings to each other while on the running tool and releases the second wear bushing from the first wear bushing when the second wear bushing lands on the first landing shoulder.

9. The apparatus of claim 8, wherein the latch mechanism comprises an interlock having a first position and a second position, wherein the first position prevents axial movement between the second wear bushing and the first wearing bushing;

the second position permits axial movement between the second wear bushing and the first wear bushing; and an actuator that moves the interlock from the first position to the second position.

10. The apparatus of claim 9, further comprising a lock mechanism operably connected to the actuator, wherein the lock mechanism prevents the actuator from moving and wherein the lock mechanism is disengaged by contact with a surface in the wellbore having a predetermined diameter.

11. The apparatus of claim 8, wherein the latch mechanism comprises:

a first groove on the second wear bushing and a second groove on the first wear bushing, a resilient lock ring with a first position and a second position, wherein the first position occupies a portion of both the first groove and the second groove, the second position does not occupy the first groove, and an actuator that pushes the resilient lock ring from the first position to the second position upon contact with the first landing shoulder.

12. The apparatus of claim 8 further comprising an alignment surface on the running tool; and wherein the alignment surface maintains axial alignment of the first wear bushing on the running tool.

13. The apparatus of claim 8, further comprising a sealing surface inside the wellbore; and a pliable ring around the outer diameter of the wear bushing, wherein the outer diameter of the pliable ring is greater than the inner diameter of the sealing surface, and wherein the pliable ring is in contact with the sealing surface when the first wear bushing is seated on the landing sub.

14. The apparatus of claim 8, further comprising a third landing shoulder, a third wear bushing, supported on the second wear bushing, the third wear bushing having a greater maximum outer diameter than an inner diameter of the third landing shoulder; and a latch mechanism that releasably latches the third wear bushing to the second wear bushing while on the running tool and releases the third wear bushing from the second wear bushing when the third wear bushing lands on the third landing shoulder.

15. A method for protecting a surface inside a wellbore comprising:

(a) attaching a first and a second wear bushing to a running tool;

(b) lowering the running tool on a drill string along with the first and second wear bushings into a wellbore;

(c) detaching the first wear bushing from the running tool at a first surface to be protected as the drill string is lowered; and (d) continuing to lower the drill string with the second wear bushing still attached, and detaching the second wear bushing at a second surface to be protected.

16. The method of claim 15, further comprising, after detaching the first and second wear bushing, continuing to lower the drill string and rotating the drill string to perform drilling.

17. The method of claim 15, wherein the first surface has a larger inner diameter than the second surface, the first wear bushing has a larger outer diameter than the second wear bushing, and the inner diameter of the first surface is such that the first wear bushing lands on the first surface while the second wear bushing passes through the first surface.

18. The method of claim 15, wherein step (a) further comprises locking the first and second wear bushing to each other with a locking mechanism.

19. The method of claim 18, wherein step (e) comprises releasing the locking mechanism in response to downward force after the first wear bushing lands on the upper surface.

20. The method of claim 15, wherein step (a) comprises: stacking the first and second wear bushings on an upward facing shoulder of the running tool.

21. A wellbore system, comprising:

an upper and a lower wellbore component, each having a bore therethrough, the lower wellbore component being located at a lower depth within a wellbore than the first wellbore component, and each wellbore component having a landing shoulder, the landing shoulder of the upper wellbore component having a larger inner diameter than an inner diameter of the landing shoulder of the lower wellbore component;

a running tool;

upper and lower wear bushings to protect each of the bore landing shoulders, wherein the wear bushings disposed on a running tool to be deployed sequentially from the running tool as the running tool is lowered through the upper and lower wellbore components to protect each of the bore surfaces of the plurality of wellbore components, and wherein the upper wear bushing has a greater outer diameter than the lower wear bushing so that the lower wear bushing passes through the upper wellbore component as the upper wear bushing lands on the upper wellbore component.

22. A wellbore protection apparatus, comprising:

a first wear bushing, the first wear bushing comprising a ring adapted to be disposed within a bore of a wellbore component to protect the bore of the wellbore component from damage;

a second wear bushing in a nesting arrangement with the first wear bushing, and a releasable connection between the first wear bushing and the second wear bushing that releases the second wear bushing from the first wear bushing in response to a downward force applied to the second wear bushing after the first wear bushing lands on a wellbore component.

* * * * *